US005655605A

United States Patent [19]

Matthews

[11] Patent Number: 5,655,605

[45] Date of Patent: Aug. 12, 1997

[54] METHOD AND APPARATUS FOR PRODUCING AND DRILLING A WELL

[76] Inventor: Cameron M. Matthews, 265 Bulyea Road, Edmonton, Alberta, Canada, T6R 1Y1

[21] Appl. No.: 488,328

[22] Filed: Jun. 7, 1995

Related U.S. Application Data

[63] Continuation-in-part of Ser. No. 61,439, May 14, 1993, Pat. No. 5,450,902.

[51] Int. Cl.[6] ..... E21B 43/18

[52] U.S. Cl. ..... 166/370; 166/50; 166/372

[58] Field of Search ..... 166/50, 303, 305.1, 166/369, 370, 372, 53

[56] References Cited

U.S. PATENT DOCUMENTS

| | | | |
|---|---|---|---|
| 3,338,306 | 8/1967 | Cook | 166/50 X |
| 3,386,508 | 6/1968 | Bielstein et al. | 166/272 |
| 3,892,270 | 7/1975 | Lindquist | 166/252 X |
| 3,986,557 | 10/1976 | Striegler et al. | 166/272 |
| 4,007,788 | 2/1977 | Striegler et al. | 166/272 |
| 4,016,942 | 4/1977 | Wallis, Jr. et al. | 177/62 X |
| 4,020,901 | 5/1977 | Pisio et al. | 166/50 |
| 4,037,658 | 7/1977 | Anderson | 166/272 |
| 4,067,391 | 1/1978 | Dewell | 166/303 |
| 4,116,275 | 9/1978 | Butler et al. | 166/303 |
| 4,160,481 | 7/1979 | Turk et al. | 166/272 |
| 4,248,302 | 2/1981 | Churchman et al. | 166/272 |
| 4,390,067 | 6/1983 | Willman | 166/50 X |
| 4,445,574 | 5/1984 | Vann | 166/268 |
| 4,458,945 | 7/1984 | Ayler et al. | 299/2 |
| 4,460,044 | 7/1984 | Porter | 166/50 X |
| 4,511,000 | 4/1985 | Mims | 166/50 X |
| 4,532,986 | 8/1985 | Mims et al. | 166/50 |

(List continued on next page.)

FOREIGN PATENT DOCUMENTS

| | | |
|---|---|---|
| 256025 | 12/1925 | Canada . |
| 286549 | 1/1929 | Canada . |
| 481151 | 2/1952 | Canada . |
| 1232196 | 2/1988 | Canada . |
| 1304675 | 7/1992 | Canada . |
| 96/10123 | 4/1996 | WIPO . |

OTHER PUBLICATIONS

Gas Lift (Book 6 of the Vocational Training Series) Introduction to Artificial Lift and Gas Lift (Chapter 1) and Intermittent Flow Gas Life (Chapter 8) Published by Production Department, American Petroleum Institute, Dallas, Texas, in 1984.

Ranney, Leo "The First Horizontal Oil Well":, *The Petroleum Engineer*, Jun. 1939, pp. 25–30.

*Primary Examiner*—Hoang C. Dang
*Attorney, Agent, or Firm*—Anthony R. Lambert

[57] ABSTRACT

The invention is directed at a method and apparatus for producing liquids, namely hydrocarbons, from a subterranean formation using a well having a collecting wellbore located at least partially within the formation. The apparatus is comprised of: a downward wellbore having a proximal end communicating with the surface and a distal end extending beneath the surface; a collecting wellbore for collecting liquids from the formation, located at least partially within the formation and communicating with the formation and the downward wellbore; a first downward production tubing string located inside the downward wellbore and extending from the proximal end to the distal end of the downward wellbore; a first collecting production tubing string located inside the collecting wellbore and communicating with the first downward production tubing string; and means for displacing a volume of the liquids from the collecting wellbore into the downward wellbore by applying a sufficient displacing pressure in the first downward production tubing string and the first collecting production tubing string to displace the volume of the liquids from the collecting wellbore in order that the volume of the liquids displaces the column of liquids within the downward wellbore and produces at least a portion of the column of liquids to the surface. The method for producing the hydrocarbons is performed by using the apparatus.

33 Claims, 3 Drawing Sheets

U.S. PATENT DOCUMENTS

| | | | |
|---|---|---|---|
| 4,595,239 | 6/1986 | Ayler et al. | 299/2 |
| 4,696,345 | 9/1987 | Hsueh | 166/245 |
| 4,982,786 | 1/1991 | Jennings, Jr. | 166/50 |
| 5,006,046 | 4/1991 | Buckman et al. | 417/54 |
| 5,016,710 | 5/1991 | Renard et al. | 166/268 X |
| 5,141,054 | 8/1992 | Alameddine et al. | 166/50 X |
| 5,148,869 | 9/1992 | Sanchez | 166/303 |
| 5,211,242 | 5/1993 | Coleman et al. | 166/372 |
| 5,236,047 | 8/1993 | Pringle et al. | 166/369 |
| 5,289,881 | 3/1994 | Schuh | 166/303 |

METHOD AND APPARATUS FOR PRODUCING AND DRILLING A WELL

CROSS REFERENCE TO RELATED APPLICATION

This is a continuation-in-part of U.S. patent application Ser. No. 08/061,439, filed May 14, 1993, now the U.S. Pat. No. 5,450,902.

TECHNICAL FIELD

The present invention relates to a method and apparatus for producing a well having a collecting wellbore located at least partially within a subterranean formation. The method and apparatus relate to the production of liquids from the formation, and in particular, both primary recovery and enhanced recovery of hydrocarbons. The invention further relates to a method for drilling the well.

BACKGROUND ART

Access to various subterranean formations containing mineral deposits may be achieved by means of one or more wells drilled from the surface into the deposit. Where the mineral deposits are in liquid form, the wells are typically produced by pumping the liquids to the surface. Many of the hydrocarbon reserves remaining in the world consist of heavy oil and bitumen which reside in oil sands deposits. Recovery from the formations containing these deposits is often uneconomical due to the poor well productivity achieved using current technology.

Conventional drilling technology provides for the drilling of wellbores from the surface to a predetermined depth beneath the surface into the subterranean formation. While most wellbores have traditionally been drilled substantially vertically or perpendicular to the surface, current drilling technology also provides for the drilling of slant wellbores at an angle to the surface. Recent advances in drilling technology allow for the drilling of a wellbore beneath the surface with a portion of the wellbore having a longitudinal axis either parallel to the surface or at an angle to it. These wellbores, often referred to as horizontal wells, allow placement of the near horizontal segment of the wellbore within the formation. Horizontal wells are typically formed by drilling a vertical wellbore downward to the desired depth beneath the surface, turning the wellbore toward the horizontal and then extending the wellbore horizontally into the formation. In such a circumstance, the entire horizontal segment of the wellbore in contact with the hydrocarbons performs the function of collecting the hydrocarbons from the formation for production to the surface.

Horizontal wellbores are therefore advantageous as compared to conventional vertical wellbores as horizontal wellbores generally allow greater contact between the wellbore and the hydrocarbon bearing formation. Generally, the longer the horizontal wellbore, the greater the contact with the formation and the greater the portion of the wellbore collecting hydrocarbons from the formation. Thus, horizontal wellbores allow for improved drainage and improved productivity from the formation.

However, several difficulties have been encountered with the use of horizontal wellbores in recovering heavy oils and other viscous liquids. One difficulty is that the length of the horizontal wellbore contributing fluids may be limited by the production system capacity. Increasing the length of the wellbore beyond the optimum for a specific production system may result in a decreased production of liquids per unit length of the wellbore.

In addition, in most cases where horizontal wellbores are produced by artificial lift means, conventional pumping system such as progressing cavity pumps are typically positioned with the pump intake above the horizontal wellbore and the liquid level is typically several meters above the intake. This places a hydrostatic head on the liquids within the horizontal wellbore which tends to impair the inflow potential of the horizontal wellbore. The inflow potential is directly related to the magnitude of the pressure differential existing between the wellbore and the surrounding formation.

Finally, conventional production systems using downhole pumps create a point source drawdown of the wellbore. As a result, productivity with these systems is limited by the inherent flow-induced pressure losses which occur along the wellbore, particularly in the case of viscous liquids. This promotes the development of a non-uniform pressure profile along the length of the wellbore which may result in non-uniform inflow along the wellbore and in either premature water breakthrough or significant sand influx near the start of the wellbore. These problems, in turn, can lead to the shut-in of the well.

Several concepts have been developed to improve productivity through the use of u-shaped wells which include a substantially horizontal wellbore segment located in the formation for collecting liquids. For example, Canadian Patent No. 481,151 issued Feb. 12, 1952 to L. Ranney discloses the drilling of a downwardly inclined hole from the surface towards a coal seam or other mineral deposit. As the hole approaches the deposit, it is deflected upwards to become substantially horizontal and parallel with the deposit. After continuing horizontally for an indefinite distance, the hole deflects upwards again and emerges at the surface. Air, oxygen or other fluids are supplied to the horizontal portion of the hole through the downwardly inclined portion, as necessary, and the mineral liquids are removed through the upwardly inclined portion. The liquids are removed through the upwardly inclined portion by pumping the liquids out in the normal or conventional fashion.

U.S. Pat. No. 4,037,658 issued Jul. 26, 1977 to D. J. Anderson also discloses the drilling of an injection shaft and a recovery shaft which both extend from the surface to a tar sand formation. A hole is formed through the tar sand formation between the shafts and a tubular member is inserted therein. To recover petroleum from the formation a hot fluid is flowed through the tubular member which heats the viscous petroleum surrounding the member and forms a potential passage for fluid flow through the formation. A drive fluid, such as steam, gas or water, is then injected from the injection shaft into the formation through the passage to promote the flow of petroleum toward the recovery shaft. However, again, the petroleum is recovered from the recovery shaft using means for lifting the petroleum from the interior of the recovery shaft, such as a pump.

U.S. Pat. No. 4,532,986 issued Aug. 6, 1985 to D. S. Mims et. al. discloses two intersected wells. A horizontal well is drilled to lie generally horizontally and adjacent to the lower border of a hydrocarbon containing layer. The horizontal well is perforated along its length and has a production end communicating with the surface and an injection end, the ends being separated by a barrier. A vertical well intercepts the injection end of the horizontal well. To recover the hydrocarbons within the formation, a stream of hot stimulating fluid, such as steam, is carried to the injection end of the horizontal well via the vertical well. Once in the horizontal well, the fluid is injected into the formation through the injection end, where it liquifies the hydrocarbons. The liquified bitumen then moves into the production end of the horizontal well where it is removed. The means for removal from the production end are not described.

U.S. Pat. No. 3,986,557 issued Oct. 19, 1976 to J. H. Striegler et. al. and U.S. Pat. No. 4,445,574 issued May 1, 1984 to R. R. Vann also utilize a u-shaped system of wellbores. However, these patents do not use conventional pumping systems to recover the hydrocarbons collected in the wells.

U.S. Pat. No. 3,986,557 discloses the drilling of a continuous wellbore having a second section, contained within a subterranean tar sand formation containing viscous bitumen, and a first and third section extending the second section to the surface. A heated fluid is circulated through the wellbore via the first section and the mobilized bitumen is recovered via the third section. The patent describes the means of recovery of the mobilized bitumen as being the driving force of the circulating heated fluid. No other means are described.

U.S. Pat. No. 4,445,574 similarly discloses the drilling of a continuous borehole extending from an inlet on the surface to an outlet on the surface having a horizontal portion extending through a pay zone containing hydrocarbons. Production is achieved by flowing a fluid into the inlet of the bore hole to flow through the entire borehole thereby forcing the production of hydrocarbons collected in the horizontal portion to the surface.

None of the systems described above appear to have been used in practice by industry because of being either physically impractical or uneconomical.

Therefore, there remains a need in the industry for a relatively uncomplicated method and apparatus for producing liquids from a subterranean formation using a well having a collecting wellbore for collecting the liquids located at least partially within the formation, which improve both the inflow potential and the uniformity of the inflow along substantially the entire length of the collecting wellbore.

DISCLOSURE OF INVENTION

The present invention relates to a method for producing liquids from a subterranean formation utilizing a well having a collecting wellbore, for collecting liquids from the formation, located at least partially within the formation and communicating with the formation. The method creates a unidirectional flow of liquids from the formation through the well by displacing the liquids drawn into the collecting wellbore from the collecting wellbore for production to the surface. Further, the invention relates to an apparatus for performing the method and a method for drilling the well to be used.

In a first aspect of the invention in its method form for producing liquids, the invention comprises a method for producing liquids from a subterranean formation using a well of the type having a first downward wellbore and a second downward wellbore for containing a column of liquids, each downward wellbore extending beneath the surface, and having a proximal end communicating with the surface and a distal end, and a collecting wellbore. The collecting wellbore is located at least partially within the formation and communicates with the formation and the downward wellbores. The first step of the method is collecting liquids from the formation in the collecting wellbore. The collecting wellbore has an internal pressure less than the average pressure of the liquids in the formation. Therefore, a pressure differential exists between the collecting wellbore and the formation which draws a volume of liquids from the formation into the collecting wellbore. The second step is displacing the volume of liquids from the collecting wellbore into the second downward wellbore. The second step develops a column of liquids within the second downward wellbore. The third step is producing at least a portion of the column of liquids within the second downward wellbore to the surface.

In the first aspect, the steps may be repeated cyclically to create a unidirectional efflux of liquids from the formation through the wellbores for production at the surface. The producing step may be performed by pumping the column of liquids from the second downward wellbore to the surface. The column of liquids may be at least partially contained in a sump located in the second downward wellbore for pumping to the surface. The producing step may be performed during the displacing step by displacing at least a portion of the column of liquids from the second downward wellbore to the surface. The displacing step and the producing step may both be performed by applying a displacing pressure in the first downward wellbore. The displacing pressure is sufficient to displace the volume of liquids from the collecting wellbore into the second downward wellbore such that the volume of liquids displaces the column of liquids contained in the second downward wellbore and produces at least a portion of the column of liquids to the surface. The displacing pressure may be applied by releasing a compressed gas in the first downward wellbore or by moving a piston in the first downward wellbore. The compressed gas may be steam. At least a part of the column of liquids remaining in the second downward wellbore after production of the portion of the column of liquids to the surface may be pumped from the second downward wellbore to the surface after the displacing step.

Further, in the first aspect, the efflux of liquids from the collecting wellbore into the formation may be minimized while applying the displacing pressure. This may be done by applying a displacing pressure which is less than the average pressure of the liquids in the formation and less than the fracturing pressure of the formation. Further, the collecting wellbore may contain a production tubing string having a plurality of foramen and communicating with the downward wellbores. In such an instance, the efflux of liquids from the production tubing string while applying the displacing pressure may be minimized by sealing the foramen during the displacing step. The foramen may be sealed by closing a valve associated with the foramen. As well, the production tubing string in the collecting wellbore may communicate with a further production tubing string contained within each of the downward wellbores such that the displacing pressure is applied in the further production tubing string in the first downward wellbore and the column of liquids is contained in the further production tubing string in the second downward wellbore. The internal pressure of the collecting wellbore may be reduced during the collecting step to enhance the pressure differential between the collecting wellbore and the formation. The internal pressure may be reduced by venting the production tubing string contained in the collecting wellbore. The viscosity of the volume of liquids in the collecting wellbore may be reduced prior to the commencement of the displacing step in order to enhance the performance of the displacing step. The viscosity may be reduced by heating the liquids in the collecting wellbore. The liquids may be heated by circulating a heated fluid through a heating tubing string contained within the collecting wellbore and in contact with the liquids.

Finally, in the first aspect, the displacing step may be enhanced by forming a plug of liquids in the collecting wellbore adjacent to the first downward wellbore prior to the displacing step. The plug may be formed by a sump located at the connection between the first downward wellbore and the collecting wellbore. The sump may have a depth beneath the surface greater than the depth of the collecting wellbore in order to permit liquids to collect in the sump to form the plug. Further, the column of liquids may be maintained within the second downward wellbore upon completion of the displacing step so that the efflux of liquids from the second downward wellbore back to the collecting wellbore may be minimized. The column of liquids may be maintained by a valve located in the second downward wellbore. The valve opens during the displacing step and closes during the collecting step. The liquids contained in the formation may be comprised of hydrocarbons, and the hydrocarbons may be heavy oils. The first downward wellbore and the second downward wellbore may be included in a single downward wellbore.

The invention further comprises an apparatus for performing the method of production. In a first aspect of the invention in its apparatus form, the invention comprises an apparatus for producing liquids from a subterranean formation. The apparatus is comprised of: a first downward wellbore having a proximal end communicating with the surface and a distal end extending beneath the surface; a second downward wellbore for containing a column of liquids having a proximal end communicating with the surface and a distal end extending beneath the surface; a collecting wellbore for collecting a volume of liquids from the formation, located at least partially within the formation and communicating with the formation and the downward wellbores such that a continuous wellbore is formed from the proximal end of the first downward wellbore to the proximal end of the second downward wellbore; means for displacing the volume of liquids from the collecting wellbore into the second downward wellbore in order to develop a column of liquids within the second downward wellbore; and means for producing at least a portion of the column of liquids within the second downward wellbore to the surface.

In the first aspect, one end of the collecting wellbore may communicate with the first downward wellbore and the other end of the collecting wellbore may communicate with the second downward wellbore. As well, the first downward wellbore and the second downward wellbore may be included in a single downward wellbore. The producing means may be comprised of at least one pump located in the second downward wellbore for pumping the column of liquids from the second downward wellbore to the surface. A sump may be located in the second downward wellbore for containing at least a portion of the column of liquids in he second downward wellbore and produces at least a portion of the column of liquids for pumping to the surface. The displacing means and the producing means may be the same means and may both be comprised of means for applying a displacing pressure in the first downward wellbore. The displacing pressure is sufficient to displace the volume of liquids from the collecting wellbore into the second downward wellbore. This, in turn, displaces the column of liquids from the second downward wellbore to the surface. The means for applying the displacing pressure may be comprised of a piston located in the first downward wellbore. Alternatively, the displacing pressure applying means may be comprised of a chamber within the first downward wellbore for containing a compressed gas and means for releasing the compressed gas in the first downward wellbore. The compressed gas may be steam. The releasing means may be comprised of a check valve located in the chamber. Further, at least one pump may be located in the second downward wellbore for enhancing the operation of the producing means.

Further, in the first aspect of the invention in its apparatus form, the apparatus may include means for minimizing the efflux of liquids from the collecting wellbore into the formation while operating the displacing pressure applying means. The efflux minimizing means may be comprised of means for regulating the displacing pressure. The displacing pressure is regulated to maintain it at less than the average pressure of the liquids in the formation and at less than the fracturing pressure of the formation. The apparatus may further comprise a production tubing string for carrying the liquids communicating with the downward wellbores and located inside the collecting wellbore. The production tubing string may have a plurality of foramen for communication between the inside of the production tubing string and the collecting wellbore There may be a valve associated with the foramen which permits the flow of liquids into the production tubing string but not out of the production tubing string such that the efflux of liquids from the collecting wellbore is minimized. As well, the production tubing string in the collecting wellbore may communicate with a further production tubing string contained within each of the downward wellbores such that the displacing means apply the displacing pressure in the further production tubing string in the first downward wellbore and the column of liquids is contained in the further production tubing string in the second downward wellbore. The apparatus may be further comprised of means for reducing the viscosity of the volume of liquids in the collecting wellbore in order to enhance the displacement of the volume of liquids. The viscosity reducing means may be comprised of heating means located within the collecting wellbore. The heating means may be comprised of a heating tubing string for circulating a heated fluid. The heating tubing string may be located within the collecting wellbore such that it is in contact with the liquids. The apparatus may be further comprised of means for reducing the internal pressure of the collecting wellbore to enhance the pressure differential between the collecting wellbore and the formation. The reducing means may include means for venting the production tubing string contained in the collecting wellbore.

In addition, in its apparatus form, the invention may be further comprised of means for forming a plug of liquids in the collecting wellbore adjacent to the first downward wellbore in order to enhance the displacement of the volume of liquids from the collecting wellbore by the displacing pressure. The means for forming the plug may be comprised of a sump located at the connection between the first downward wellbore and the collecting wellbore. The sump may have a depth beneath the surface greater than the depth of the collecting wellbore in order to permit the liquids to collect in the sump to form the plug. The collecting wellbore may include a liner having a plurality of foramen for communication between the inside of the liner and the collecting wellbore. Alternatively, the collecting wellbore may include a casing having a plurality of foramen for communication between the inside of the casing and the collecting wellbore. The apparatus may be further comprised of means for maintaining the column of liquids within the second downward wellbore so that the efflux of liquids from the second downward wellbore back to the collecting wellbore is minimized. The maintaining means may be comprised of a valve located in the second downward wellbore which permits the flow of liquids toward but not away from the proximal end of the second downward wellbore. The check valves in the apparatus may be of a type having a ball and seat. Alternatively, the check valves may be of a type having a flapper. The liquids produced by the apparatus may be hydrocarbons. The hydrocarbons may be a heavy oil.

Finally, the invention also comprises a method of drilling a well for producing the liquids. The first step in the drilling method is drilling a first downward wellbore from the surface to a first position beneath the surface to form a first downward section. The second step is extending the first downward wellbore by drilling from the first position to a second position within or adjacent to the formation to form a first angle build section. The first angle build section has a longitudinal axis gradually deviating from the longitudinal axis of the first downward section to the second position. The third step is drilling a first collecting wellbore from the second position on the first downward wellbore for a distance such that the first collecting wellbore is located at least partially within the formation. The fourth step is drilling a second downward wellbore from the surface to a third position beneath the surface to form a second downward section. The fifth step is extending the second downward wellbore by drilling from the third position to a fourth position within or adjacent to the formation to form a second angle build section The second angle build section has a longitudinal axis gradually deviating from the longitudinal axis of the second downward section towards the first collecting wellbore to the fourth position. The final step is drilling a second collecting wellbore at least partially within the formation from the fourth position on the second downward wellbore to the first collecting wellbore. The second collecting wellbore has a longitudinal axis that intersects the longitudinal axis of the first collecting wellbore. In this manner, the first collecting wellbore and the second collecting wellbore are joined in order to form a continuous wellbore throughout the well.

In the first aspect, the first collecting wellbore and the second collecting wellbore may be located in substantially the same plane. In addition, the longitudinal axes of the collecting wellbores may coincide in order that the intersection between them is smooth. To enhance a smooth intersection, the diameter of the second collecting wellbore may be greater than the diameter of the first collecting wellbore. In addition, to facilitate the intersection, the location of the first collecting wellbore may be surveyed prior to drilling the second collecting wellbore. The first downward section and the first angle build section may be cased prior to drilling the first collecting wellbore. The second downward section and the second angle build section may be cased after drilling the second collecting wellbore. A perforated liner may be installed in the first collecting wellbore and the second collecting wellbore after drilling the second collecting wellbore Alternatively, the collecting wellbores may be cased after drilling the second collecting wellbore and the casing perforated to form a plurality of foramen therein. A sump may be formed at the point of connection between the first downward wellbore and the first collecting wellbore. The sump may have a depth beneath the surface greater than the depth of the first collecting wellbore.

In a second aspect of the invention with respect to its drilling method, the method may include the step of locating an existing wellbore rather than drilling the wellbore. For instance, instead of drilling a first downward wellbore, an existing first downward wellbore may be located. In addition, instead of drilling a second downward wellbore, an existing second downward wellbore may be located. In addition, instead of drilling a collecting wellbore, a single existing collecting wellbore may be located or an existing first collecting wellbore and an existing second collecting wellbore may be located.

BRIEF DESCRIPTION OF DRAWINGS

Embodiments of the invention will now be described with reference to the accompanying drawings in which.

BEST MODE OF CARRYING OUT INVENTION

The present invention is directed at an apparatus and method for producing or recovering liquids from a subterranean formation using a well. The liquids to be produced may be naturally occurring or may be sub-surface minerals converted to liquids prior to recovery. These liquids include, amongst others, groundwater, mineral oils, sulphur, and hydrocarbons. The present invention may be used to recover any such liquids. However, in its preferred embodiment, the invention is directed towards the recovery of hydrocarbons, and in particular, conventional and heavy oils. The present invention is most advantageously used for the recovery of heavy oils or more viscous liquids. The apparatus and method described herein may be used for both primary recovery of hydrocarbons and in conjunction with enhanced recovery techniques known in the art.

Figure 1:
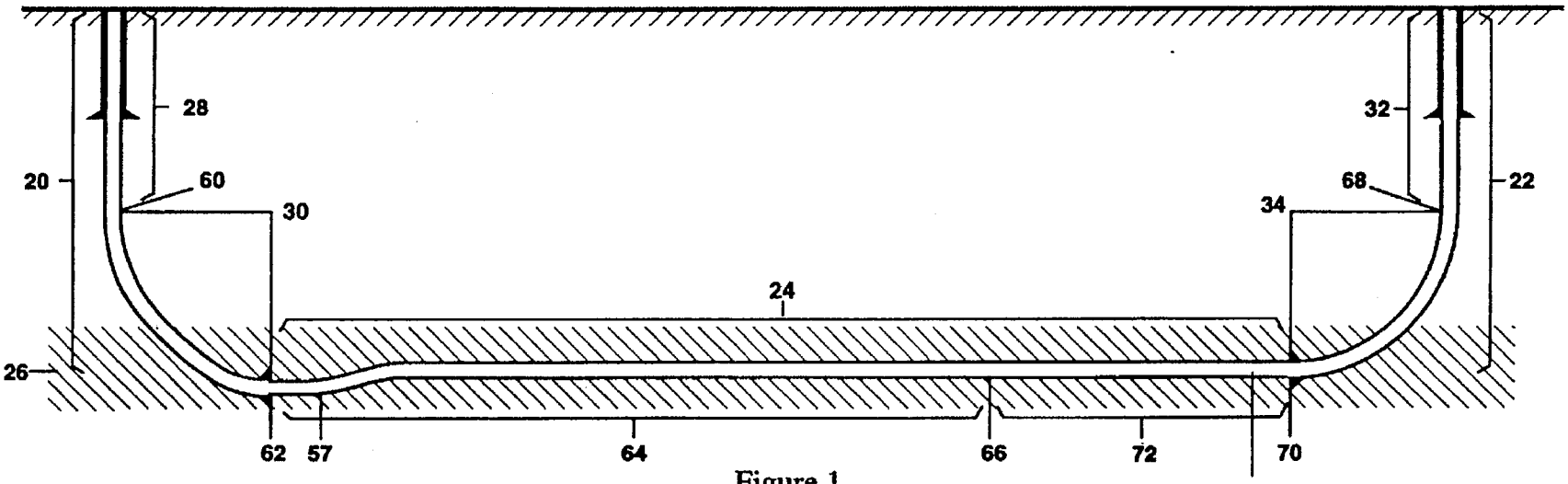
FIG. 1 is a schematic diagram of a side view of a well.

Referring to FIG. 1, the preferred embodiment of the invention is its apparatus form is comprised of a well having a continuous wellbore for the production of hydrocarbons contained in a subterranean formation. The well is comprised of a first downward wellbore (20), a second downward wellbore (22) and a collecting wellbore (24) joined or connected together. The collecting wellbore (24) is joined or connected to both of the downward wellbores (20, 22) in a manner to communicate with them and is located at least partially within the formation (26). The collecting wellbore (24) is the portion of the well communicating with the formation (26) such that hydrocarbons may pass from the formation into the well. The resulting wellbore is continuous as these separate or individual wellbores are joined or connected together in a manner to communicate with each other and to allow liquids placed in one end of the well to flow through all the wellbores to the other end of the well.

The first downward wellbore (20) and the second downward wellbore (22) each has a proximal end communicating with the surface and a distal end extending for a distance beneath the surface. The distance that each of the distal ends extends beneath the surface, or the depth of each distal end, is determined by the desired location of the distal end with respect to the formation (26) and the overall configuration of the well. Each distal end may be located at any location within or adjacent to the formation (26).

The first downward wellbore (20) is comprised of a first downward section (28) and a first angle build section (30). The first downward section (28) runs from the proximal end of the first downward wellbore (20) to a position above the formation (26). The first angle build section (30) runs from the position above the formation (26) to the distal end of the first downward wellbore (20). The longitudinal axis of the first downward wellbore (20 in the first downward section (28) is typically at approximately 90 degrees to the surface. However, this angle may be varied as desired or as necessary to reach the formation (26). The longitudinal axis of the first downward wellbore (20) in the first angle build section (30) gradually deviates from the longitudinal axis in the first downward section (28) to the longitudinal axis of the collecting wellbore (24). However, this deviation may not be necessary or desirable in some circumstances.

The second downward wellbore (22) includes a second downward section (32) and a second angle build section (34). The second downward section (32) runs from the proximal end of the second downward wellbore (22) to a position above the formation (26). The longitudinal axis of the second downward wellbore (22) in the second downward section (28) is typically at approximately 90 degrees to the surface. However, this angle may also be varied as necessary or as desired to reach the formation (26). The second angle build section (34) runs from the position above the formation to the distal end of the second downward wellbore (22). Preferably the longitudinal axis of the second downward wellbore (22) in the second angle build section (34) gradually deviates from the longitudinal axis of the second downward section (32) to the longitudinal axis of the collecting wellbore (24). However, this deviation may not be necessary or desirable in some circumstances.

In the preferred embodiment, the location of the second downward wellbore (22) is chosen so that the proximal end of the second downward wellbore (22) is a spaced distance apart from the proximal end of the first downward wellbore (20). The distance between the two proximal ends on the surface is determined by the dimensions of the angle build sections (30, 34) of the downward wellbores (20, 22) and the length of the collecting wellbore (24) between the downward wellbores (20, 22). The proximal ends are typically several hundred meters apart.

As stated, the collecting wellbore (24) is located at least partially within the formation (26). For optimum results of the method of production described herein, the entire collecting wellbore (24) should lie within the formation (26) to achieve the greatest contact between the formation (26) and the collecting wellbore (24). However, this is often not possible given the shape, orientation or location of the formation (26). Therefore, the collecting wellbore (24) is located such that at least a portion of the collecting wellbore (24) lies within the formation (26). The length of the collecting wellbore (24) is typically from several hundred meters to two thousand meters. The length is partly determined by the amount of desired communication between the collecting wellbore (24) and the formation (26) and the specifications and capabilities of the production system being utilized to recover the hydrocarbons.

Figure 3:
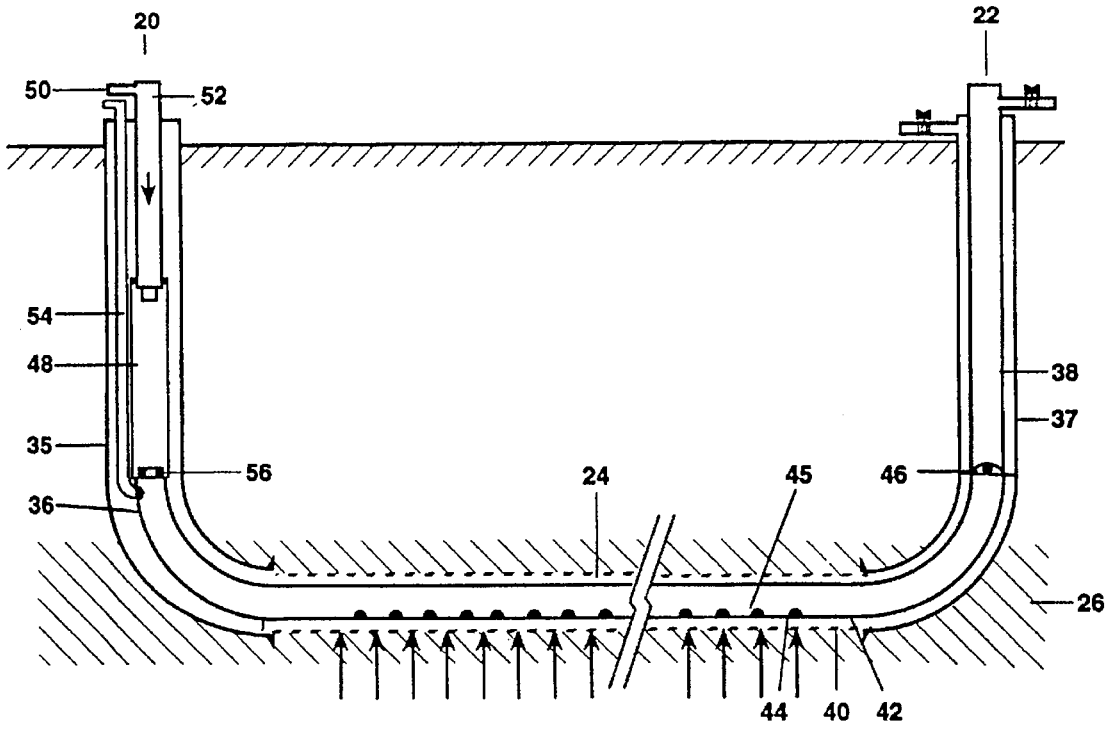
FIG. 3 is a schematic diagram of a side view of the well showing a gas lift production system.
Figure 4:
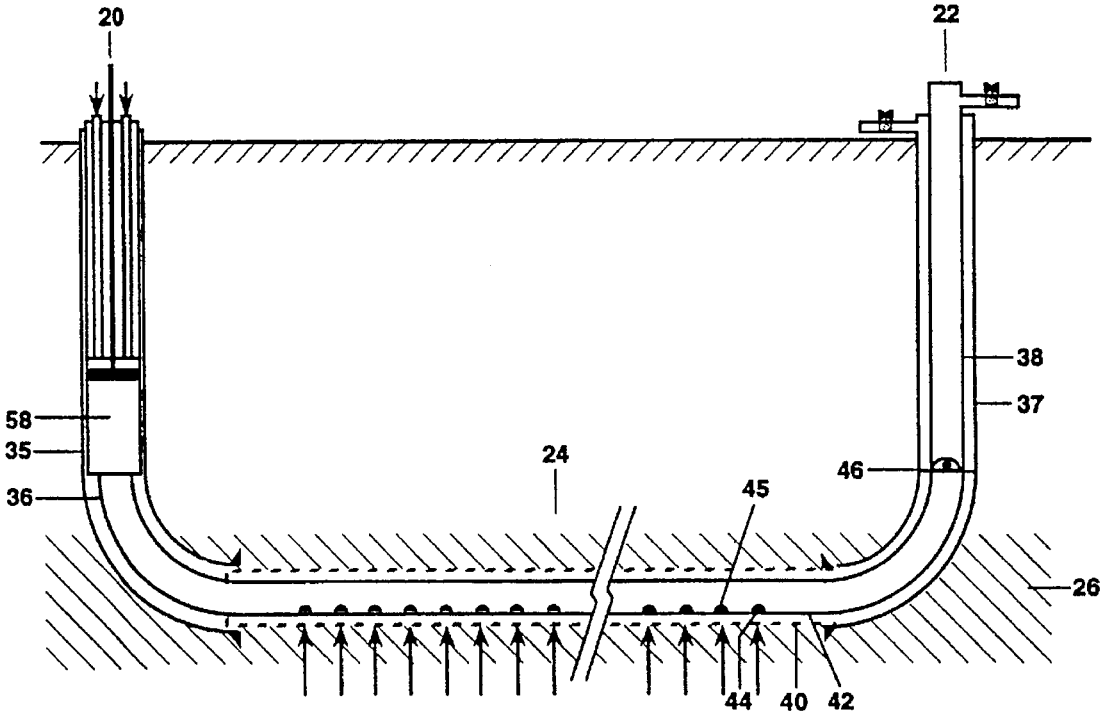
FIG. 4 is a schematic diagram of a side view of the well showing a plunger lift production system.

One end of the collecting wellbore (24) communicates with the first downward wellbore (20) and the other end of the collecting wellbore (24) communicates with the second downward wellbore (22). Preferably, the collecting wellbore (24) is connected to each downward wellbore (20, 22) at their distal ends as shown in FIGS. 1, 3 and 4. The connections between the wellbores are made using conventional drilling and completion technology. However, the connection of the collecting wellbores (24) to each downward wellbore (20, 22) may be at any location along the length of the downward wellbores (20, 22). The specific location of the connection will depend upon the desired depth of the collecting wellbore (24) beneath the surface, the desired location of the collecting wellbore (24) within the formation (26) and the location of the downward wellbores (20, 22) including their distal ends.

Figure 2:
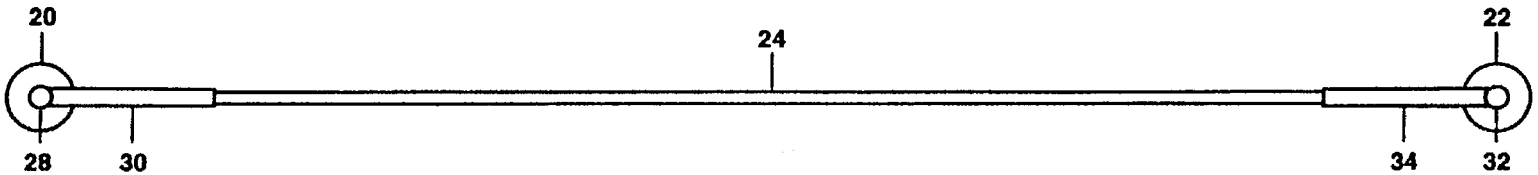
FIG. 2 is a schematic diagram of a top view of the well.

In the preferred embodiment, the downward wellbores (20, 22) and the collecting wellbore (24) are joined to form a well having a substantially u-shaped configuration. This will occur when the longitudinal axes of the downward wellbores (20, 22) deviate in the angle build sections (30, 34), as described above, and the entire collecting wellbore (24) lies at substantially one depth beneath the surface. However, the longitudinal axes of the angle build sections (30, 34) may not deviate the same amount or to the same degree or the longitudinal axis of only one of the angle build sections (30, 34) may deviate. In addition, the collecting wellbore (24) may be comprised of two or more separate or individual collecting wellbores connected together to form a continuous collecting wellbore (24). In this circumstance, it is preferable that the collecting wellbores intersect smoothly and that the entire length of the collecting wellbore (24) has a substantially straight longitudinal axis. In other words, the longitudinal axes of each separate collecting wellbore coincide. Where the preferred connection occurs, as shown in FIG. 2, the well is typically substantially u-shaped.

However, in some circumstances, it may be necessary or desirable for the collecting wellbore (24) to be comprised of two or more separate collecting wellbore sections connected together at various angles such that a bend occurs at the point of intersection of one collecting wellbore section to another collecting wellbore section. The longitudinal axes of the separate wellbore sections intersect to form a continuous collecting wellbore (24) but do not coincide. As well, the longitudinal axes of each collecting wellbore section may be positioned in different planes within the formation (26). These types of connections between the separate collecting wellbore sections may be necessary because of difficulties in directionally controlling the wellbore path or in order to locate a greater portion of the collecting wellbore (24) within the formation (26). In such a circumstance, the well may not appear substantially u-shaped.

In the preferred embodiment, the first downward wellbore (20), the collecting wellbore (24) and the second downward wellbore (22) are joined in a manner that the wellbores communicate to form a continuous wellbore such that liquids may flow from the proximal end of the first downward wellbore (20) to the proximal end of the second downward wellbore (22). Referring to FIGS. 3 and 4, production casing strings (35, 37) are run in the first downward wellbore (20) and the second downward wellbore (22) respectively and are cemented into place in a conventional manner. The downward wellbores (20, 22) are preferably cased from the surface to the desired producing interval in the formation (26) to prevent the collapse of the wellbores (20, 22). The collecting wellbore (24) is located at the desired producing interval or depth in the formation (26) and thus the casing extends to the point of connection between the downward wellbores (20, 22) and the collecting wellbore (24). A production tubing string (36, 38) is run through the casing in each of the first and second downward wellbores (20, 22).

The collecting wellbore (24) is preferably cased with a liner to prevent collapse of the wellbore (24). The collecting wellbore (24) must communicate with the formation (26) in order that hydrocarbons may enter the collecting wellbore (24). Therefore, the liner may be pre-perforated or slotted to have a plurality of foramen therein, or the liner may be perforated after placement in the collecting wellbore (24). One end of the liner is hung from a conventional liner hanger set in the first downward wellbore (20) adjacent to the end of the production casing string (35) located therein and the other end of the liner will rest unsupported within the second downward wellbore (22) adjacent to the end of the production casing string (37) located therein, or be supported by a liner hanger positioned at this location.

Although the use of a pre-perforated liner is preferred, the collecting wellbore (24) may also be left open hole or be cased in a manner similar to that described for the downward wellbores (20, 22). Where the collecting wellbore (24) is cased and cemented, the casing is subsequently perforated to form a plurality of foramen (40) through which the hydrocarbons may pass from the formation (26) to the inside of the collecting wellbore (24).

The collecting wellbore (24) has an internal pressure less than the average pressure of the hydrocarbons in the formation (26). The existence of the collecting wellbore (24) causes a drop in pressure between the drainage boundary of the formation (26) and the interface between the formation (26) and the collecting wellbore (24). As a result, the average pressure of the hydrocarbons in the formation (26) is a pressure between the pressure at the drainage boundary of the formation (26) and the pressure at the interface between the formation (26) and the collecting wellbore (24). The pressure differential between the collecting wellbore (24) and the average pressure of the hydrocarbons in the formation (26) creates the forces necessary for a volume of hydrocarbons to be drawn from the formation (26) into the collecting wellbore (24). The perforated liner or casing in the collecting wellbore (24) allows the hydrocarbons to pass therethrough as they are drawn from the formation (26) into the collecting wellbore (24).

Referring to FIGS. 3 and 4, a production tubing string (42) runs through the collecting wellbore (24) and communicates with the production tubing strings (36, 38) in each downward wellbore (20, 22). The connections between the production tubing strings (42) in the collecting wellbore (24) and the production tubing strings (36, 38) in the downward wellbores (20, 22) are made using known completion techniques. Preferably, all connections are substantially sealed in order to minimize the efflux of gas or hydrocarbons from the production tubing strings (36, 38, 42) during the method of production.

The production tubing string (42) in the collecting wellbore (24) includes a plurality of foramen (44) distributed throughout the length of the collecting wellbore (24) to allow communication between the collecting wellbore (24) and the inside of the production tubing string (42). As a result, hydrocarbons may pass from the formation (26), through the foramen (40) in the casing, into the collecting wellbore (24) and from the collecting wellbore (24), through the foramen (44) in the production tubing string (42), into the inside of the production tubing string (42). A valve (45), preferably a check valve, is located in each of the foramen (44) in the production tubing string (42) to regulate or control the communication between the production tubing string (42) and the collecting wellbore (24). The check valve (45) is able to be opened to permit the flow of hydrocarbons into the production tubing string (42) and closed to minimize the efflux of hydrocarbons from the production tubing string (42) back into the collecting wellbore (24) and into the formation (26). In the preferred embodiment, the check valve (45) is of the type that closes to seal the foramen (44) when the pressure within the production tubing string (42) is greater than the pressure within the collecting wellbore (24) surrounding the production tubing string (42). The check valve (45) may be of any type including a ball and seat valve or a flapper valve.

The valves (45) in the foramen (44) of the production tubing string (42) may be associated with means for selectively activating the valves (45) in order to selectively control or limit the communication between the production tubing string (42) and the collecting wellbore (24). In other words, specific valves (45) along the production tubing string (42) may be activates while others are deactivated. As a result, communication between the production tubing string (42) and the collecting wellbore (24) is permitted only at selected points or intervals along the production tubing string (42). Preferably, the selective activating means are comprised of a pressure activated system connected to the surface such that cyclic changes in pressure at the surface cyclically activates and deactivates the valves (45).

A valve (46), preferably a check valve, is also located within the production tubing string (38) in the second downward wellbore (22) between the proximal and distal ends. Preferably, the check valve (46) is located closer to the distal end than the proximal end, in the second angle build section (34). The check valve (46) permits the flow of hydrocarbons towards but not away from the proximal end of the second downward wellbore (22). The check valve (46) opens when the pressure in the second downward wellbore (22) upstream from the check valve (46) is greater than the pressure in the second downward wellbore (22) downstream from the check valve (46). Correspondingly, the check valve (46) closes when the pressure in the second downward wellbore (22) upstream from the check valve (46) decreases to less than the pressure in the second downward wellbore (22) downstream from the check valve (46) to minimize the back-flow of hydrocarbons. Thus the check valve (46) can maintain a column of hydrocarbons within the second downward wellbore (22) for production to the surface.

The preferred embodiment of the invention in its apparatus form is further comprised of means for displacing a volume of hydrocarbons contained in the collecting wellbore (24) into the second downward wellbore (22) in order to develop a column of hydrocarbons within the second downward wellbore (22). The volume of hydrocarbons is collected in the collecting wellbore (24) as a result of the pressure differential existing between the collecting wellbore (24) and the formation (26) as described above. The invention in its apparatus form is also comprised of means for producing the column of hydrocarbons within the second downward wellbore (22) to the surface. In the preferred embodiment, the displacing means and the producing means are the same means.

The displacing means and the producing means are both comprised of means for applying a displacing pressure in the first downward wellbore (20). The magnitude and duration of the displacing pressure must be sufficient to displace the volume of hydrocarbons from the collecting wellbore (24) into the second downward wellbore (22) such that the displaced volume of hydrocarbons similarly displaces the column of hydrocarbons from the second downward wellbore (22) to the surface. As shown in FIGS. 3 and 4, the means for applying the displacing pressure are preferably located within the first downward wellbore (20).

Referring to FIG. 3, the preferred means for applying the displacing pressure are comprised of a gas lift system. The gas lift system uses compressed gases to apply the displacing pressure. Compressed fluids may also be used. The gas is accumulated and compressed on the surface and is then transferred and stored in a storage vessel referred to as a pressure buildup chamber or accumulator (48). The accumulator (48) may be located on the surface, but preferably is located in the first downward wellbore (20), in which case the accumulator (48) is formed by a segment of larger diameter tubing in the production tubing string (36). The accumulator (48) is connected to a compressor system on the surface (not shown) at a point of connection (50) by a tubular string (52) which feeds temperature controlled gases downhole to the accumulator (48). The gas may be stream or another heated gas. Where steam or a heated gas is used, the steam or heated gas may, upon contact with the hydrocarbons in the collecting wellbore (24), reduce the viscosity of the hydrocarbons. By reducing the viscosity of the hydrocarbons, the operation of the displacing means may be enhanced.

A pressure bleed-off line (54) connects the production tubing string (36) at a point adjacent to the accumulator (48) to the surface to permit regulation of the pressure within the production tubing string (42). The pressure bleed-off line (54) permits the venting or release of gas trapped in the production tubing string (42) in the collecting wellbore (24) to enhance the pressure differential between the collecting wellbore (24) and the formation (26).

The compressor system (not shown) connected at the point of connection (50) must have capacity to sufficiently charge the accumulator (48). The accumulator (48) is sufficiently charged when it contains sufficient compressed gases to apply a sufficient displacing pressure into the first downward wellbore (20). The displacing pressure is sufficient when upon release of the gases into the first downward wellbore (20), the gases have enough energy to expand and displace the volume of hydrocarbons in the collecting wellbore (24), making allowances for minor losses of gases from the production tubing strings (42, 36, 38) in the collecting wellbore (24) and downward wellbore (20, 22). Preferably, when using the gas lift system, the production tubing strings (42, 36, 38) are sealable such that they may be sealed to form a closed system during release of the gases in order to minimize any loss of gases from the production tubing strings (42, 36, 38) until desired. As this may not be practically feasible in some applications, the amount of compressed gases to be released from the accumulator (48) is adjusted to account for loss of gases due to leakage.

The pressure within the accumulator (48) is monitored and regulated on the surface by conventional means and gauges associated with the compressor system. The accumulator (48) is further equipped with a mechanical or pressure activated valve (56), preferably a check valve, located at the end of the accumulator (48) nearest the distal end of the first downward wellbore (20). The check valve (56) separates the compressed gases in the accumulator (48) from the remainder of the production tubing string (36) in the first downward wellbore (20) and releases the compressed gases from the accumulator (48) downward into the production tubing string (36) toward the distal end of the first downward wellbore (20). The downward wellbores (20, 22), the collecting wellbore (24), the production tubing strings (42, 36, 38) and the accumulator (48) are all sized according to the requirements of each specific application. In most instances, the first and second downward wellbores (20, 22) will have different diameters so that the wellbores may accommodate any production system components located therein.

A sump (57) may be located at the connection between the first downward wellbore (20) and the collecting wellbore (24) to enhance the displacement of the volume of hydrocarbons from the collecting wellbore (24) by the compressed gases. The sump (57) will enhance the displacement in circumstances where the collecting wellbore (24), and in particular the production tubing string (42), is not completely filled with hydrocarbons when the compressed gas is released by aiding in minimizing the amount of compressed gas that overrides the hydrocarbons in the production tubing string (42). The sump (57) is located at a depth beneath the surface greater than the depth of the collecting wellbore (24), preferably by at least three wellbore diameters, and is several meters in length. The sump (57) permits hydrocarbons to collect through gravitational effects to form a liquid plug within the production tubing string (42) in the collecting wellbore (24) adjacent to the distal end of the first downward wellbore (20).

A conventional pumping system or a plurality of pumps may be located in the second downward wellbore (22) to lift the hydrocarbons to the surface. The pumping systems enhance the operation of the producing means and may pump on a continuous or cyclic basis to improve the productivity of the well.

In a second embodiment of the invention in its apparatus form, the collecting wellbore (24) does not contain a production tubing string (42). This embodiment is applicable for use when the average pressure of the hydrocarbons in the formation (26) is relatively high compared to the internal pressure of the collecting wellbore (24). In this case, the liner or perforated casing, as described above, would act as a conduit for the hydrocarbons collected in the collecting wellbore (24). Conventional means for regulating the displacing pressure would be associated with the production system. The regulating means regulate the displacing pressure to maintain it at less than the average pressure of the hydrocarbons in the formation (26) and at less than the fracturing pressure of the formation (26). The displacing pressure is maintained at less than the average pressure of the hydrocarbons in the formation (26) in order to minimize the efflux of hydrocarbons from the collecting wellbore (24) back into the formation (26).

Referring to FIG. 4, in a third embodiment of the invention in its apparatus form, a plunger lift system is used in place of the gas lift system to perform the liquid displacement function. In the plunger lift system, the means for applying the displacing pressure are comprised of a piston (58) or plunger located within the first downward wellbore (20). The plunger lift system applies the displacing pressure into the first downward wellbore (20) sufficient to displace a portion of the volume of hydrocarbons from the collecting wellbore (24) into the second downward wellbore (22) such that the displaced volume similarly displaces the column of hydrocarbons from the second downward wellbore (22) to the surface. The displacing pressure is applied by the piston (58) installed in the first downward wellbore (20). This piston (58) is movable between a raised position nearer to the proximal end of the first downward wellbore (20) and a lowered position nearer to the distal end of the first downward wellbore (20) through either hydraulic means or mechanically through gravitational forces and a conventional rod or cable drive system. The diameter of the first downward wellbore (20) and the length of the piston stroke are varied to produce the desired displacement of hydrocarbons. Generally, the displacement of hydrocarbons is increased by increasing the diameter of the piston in the first downward wellbore (20) and the length of the piston stroke.

In a fourth alternative embodiment of the invention in its apparatus form, the means for producing the column of hydrocarbons in the second downward wellbore (22) are separate from the means for displacing the volume of hydrocarbons from the collecting wellbore (24). In this fourth embodiment, the producing means are comprised of at least one conventional pump (not shown). At least one pump is located in the second downward wellbore (22) to pump the column of hydrocarbons from the second downward wellbore (22) to the surface. The pump is able to be operated on either a continuous or cyclic basis once the column of hydrocarbons is developed in the second downward wellbore (22). To facilitate the pumping action, a sump (not shown) may be located in the second downward wellbore (22), preferably adjacent to the collecting wellbore (24). The sump contains at least a portion of the column of hydrocarbons for pumping to the surface.

Figure 5:
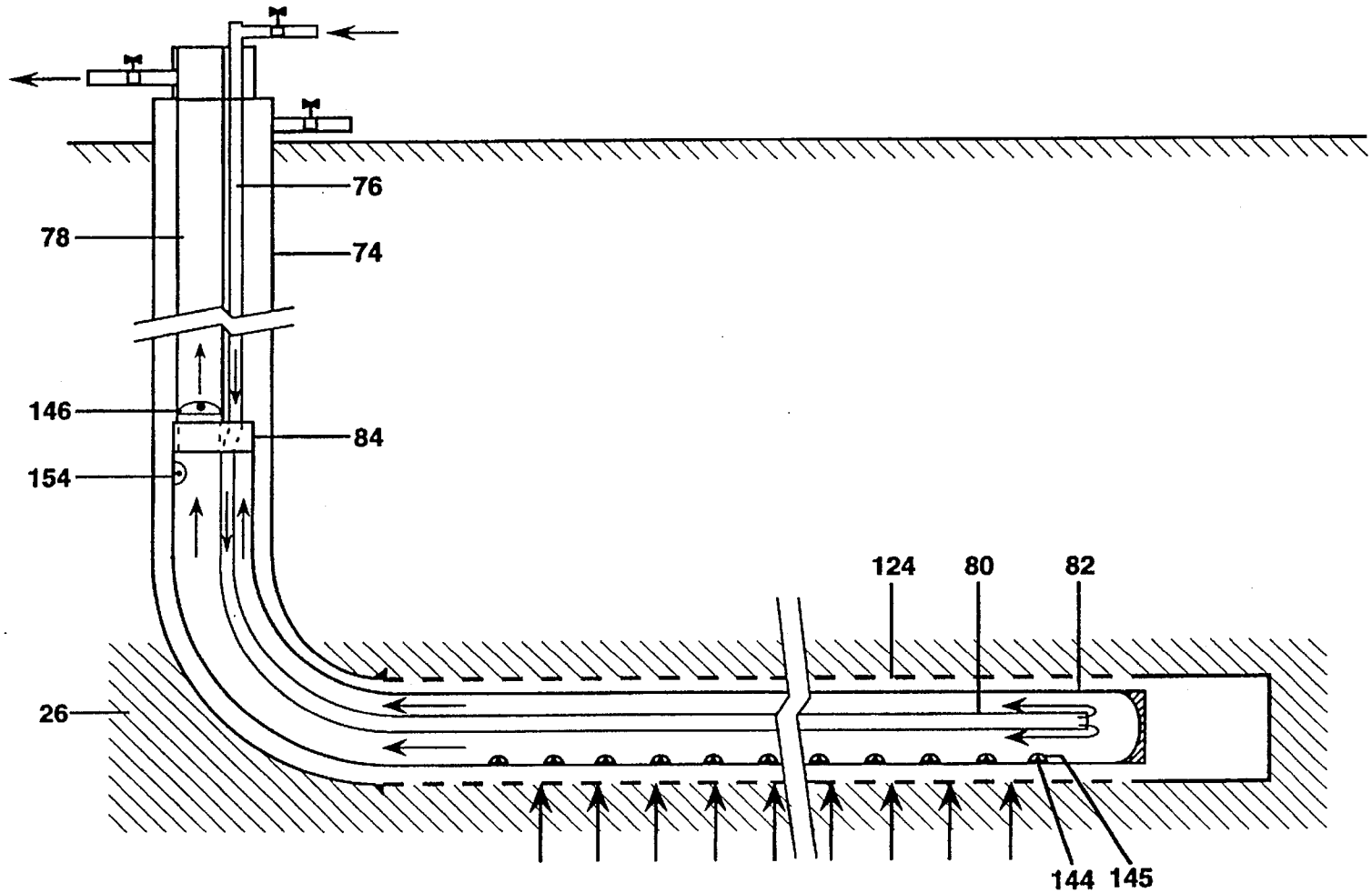
FIG. 5 is a schematic diagram of a side view of an alternate embodiment of the well having a single downward wellbore.

A fifth embodiment of the invention in its apparatus form is shown in FIG. 5. Where parts are similar and have the same function as the preferred embodiment, the same reference number is used raised by 100. In this embodiment, the first and second downward wellbores (20, 22) of the preferred embodiment form a single downward wellbore (74) having a proximal end communicating with the surface and a distal end. The collecting wellbore (124) communicates with the single downward wellbore (74). The single downward wellbore (74) contains two production tubing strings: an injection string (76), also called a first downward production tubing string, to contain the displacing means and a production string (78), also called a second downward production tubing string, to communicate produced hydrocarbons to the surface. Thus, in this embodiment, the injection string (76) contains the accumulator (not shown in FIG. 5). Alternatively, the accumulator may be located on the surface. The collecting wellbore (124) also contains two production tubing strings. An inner production tubing string (80), also called a first collecting production tubing string, is run through the inside of an outer production tubing string (82), also called a second collecting production tubing string. The outer production tubing string (82) of the collecting wellbore (124) contains a plurality of foramen (144) including check valves (145) which are the same as the check valves (45) described in the preferred embodiment. The inner production tubing string (80) of the collecting wellbore (124) has no foramen.

At the base of the single downward wellbore (74), near the point of connection with the collecting wellbore (124), the adjacent ends of the production tubing strings (80, 82) in the collecting wellbore (124) and the injection and production strings (76, 78) in the single downward wellbore (74) are joined. A flow diversion bullhead (84) connects the injection string (76) in the single downward wellbore (74) to the inner production tubing string (80) in the collecting wellbore (124) and similarly connects the annulus between the inner and outer production tubing strings (80, 82) in the collecting wellbore (124) to the production string (78) in the single downward wellbore (74). the flow diversion bullhead (84) diverts hydrocarbons exiting from the injection string (76) in the single downward wellbore (74) into the inner production tubing string (80) in the collecting wellbore (124) and diverts hydrocarbons exiting from the outer production tubing string (82) into the production string (78) in the single downward wellbore (74). The inner and outer production tubing strings (80, 82) communicate at the other end of the collecting wellbore (124). A check valve (146) is located adjacent to the flow diversion bullhead (84) within the production string (78) in the single downward wellbore (74). The structure and operation of the check valve (146) are the same as the check valve (46) located in the second downward wellbore (22) in the preferred embodiment. A further check valve (154) is located below the flow diversion bullhead (84) which serves to vent the production string (78) in a manner similar to the pressure bleed-off line (54) in the preferred embodiment shown in FIG. 3. The remainder of the structure of the well and the operation of the production system are the same as in the preferred embodiment.

The flow diversion bullhead (84) and the inner and outer production tubing strings (80, 82) in the collecting wellbore (124) may be replaced by two parallel production tubing strings which communicate at the end of the collecting wellbore (124) not connected to the single downward wellbore (74). In such a circumstance, the production tubing string in the collecting wellbore (124) connected to the production string (78) in the single downward wellbore (74) would contain a plurality of foramen and act in a manner similar to the outer production tubing string (82) described above.

As a further alternative, the flow diversion bullhead (84) and the injection and production strings (76, 78) in the downward wellbore (74) may be replaced by an inner production string run through the inside of an outer production string. The inner production string would perform the purpose and function of the injection string (76) and be connected to the inner production tubing string (80) of the collecting wellbore (124). The outer production string would perform the purpose and function of the production string (78) and be connected to the outer production tubing string (82) of the collecting wellbore (124). Preferably, a packer assembly with a valve would be located adjacent the point of connection between the inner production string in the downward wellbore and the inner production tubing string (80) in the collecting wellbore (124). The packer assembly would extend from the inner production string to the outer production string to seal the annulus between the two and prevent communication of hydrocarbons from one side of the packer assembly to the other side except through the valve in the packer assembly. Thus, the packer assembly and the valve perform the same purpose and function as the valve (46) located in the second downward wellbore (22) in the preferred embodiment.

As an even further alternative, the configuration of the production strings in the downward wellbore (74) could be reversed so that the inner production string would perform the function of the production string (78) and be connected to the outer production tubing string (82) of the collecting wellbore (124), while the outer production string would perform the function of the injection string (78) and be connected to the inner production string (80) of the collecting wellbore (124).

Although use of a production string (78) and an outer production tubing string (82) are preferred in this embodiment, the downward wellbore (74) and the collecting wellbore (124) may be cased, as described for the preferred embodiment, in order to perform the function of the production string (78) and the outer production tubing string (82). In this case, the injection string (76) would be run inside the cased downward wellbore (74), which would act as the production string (78). The inner production tubing string (80) would be run inside the cased collecting wellbore (124), which would act as the outer production tubing string (82).

Further, the inner production tubing string (80) may include one or more foramen, or other means of communication with the outer production tubing string (82), distributed throughout its length to allow greater communication between the inside of the inner production tubing string (80) and the annulus between the outer production tubing string (82) and the inner production tubing string (80). Preferably, a pressure activated valve would be located in each of the foramen to permit the flow of gases or liquids out of, but not back into, the inner production tubing string (80). The valves in the foramen of the inner production tubing string (80) may be associated with selective activating means similar to those described previously with respect to the valves (45) in the production tubing string (42) in the preferred embodiment. As a result, for example, a compressed gas released into the injection string (76) would pass through the inner production tubing string (80) and through the foramen or other means of communication. However, hydrocarbons collected in the outer production tubing string (82) would be inhibited from passing into the inner production tubing string (80). If the production tubing strings (80, 82) in the collecting wellbore (124) are parallel to each other, as described above, communication between the adjacent sides of the production tubing strings (80, 82) may similarly be provided for.

Communication may also be similarly provided for between the injection string (76) and the production string (78) in the downward wellbore (74). Again, valves at the points of communication would permit the flow of gases or liquids out of, but not back into, the injection string (76). These communication valves would be used to assist in producing the column of hydrocarbons contained in the downward wellbore (74) to the surface, as described further below. These communication valves may also be associated with selective activating means similar to those as described previously with respect to the valves (45) in the production tubing string (42) in the preferred embodiment.

Finally, one or more barriers, packers or other means (not shown) may be provided for sealing between the outside of the outer production tubing string (82) and the inside of the collecting wellbore (124). The barriers would be located in the annulus between the outer production tubing string (82) and the collecting wellbore (124) at spaced intervals along the length of the collecting wellbore (124) resulting in two or more discrete chambers within the annulus which do not communicate with each other. Thus, hydrocarbons from the formation will enter the chambers within the collecting wellbore (124) and then pass into the outer production tubing string (82) through the foramen (44) adjacent each chamber. By selectively activating or controlling the valves in each foramen, the flow of hydrocarbons from each chamber may be controlled.

In any of the embodiments described above, the invention in its apparatus form may be further comprised of means for reducing the viscosity of the volume of hydrocarbons collected in the collecting wellbore. The viscosity reducing means are heating means located within the collecting wellbore (24). Heating means may be necessary where the liquids or hydrocarbons are relatively viscous. The heating means reduce the viscosity of the hydrocarbons and thereby enhance the operation of the displacing means.

The heating means may be comprised of a small diameter heating tubing string, relative to the production tubing strings (36, 38, 42). for heating the hydrocarbons. The heating tubing string is installed inside the collecting wellbore (24) in order to be in contact with the hydrocarbons collected therein. A hot fluid is circulated through the heating tubing string from the surface.

The apparatus for producing the hydrocarbons, as described herein, may be used in performing the following preferred method for producing liquids or hydrocarbons from the subterranean formation. In the preferred embodiment of the invention in its method form, the liquids are hydrocarbons.

In the preferred embodiment of the invention in its method form, the first step comprising the method is collecting a volume of hydrocarbons from the formation in the production tubing string (42) located in the collecting wellbore (24). The collecting wellbore (24) has an internal pressure less than the average pressure of the hydrocarbons in the formation (26). The average pressure is some pressure between the pressure of the drainage boundary of the formation (26) and the pressure at the interface between the formation (26) and the collecting wellbore (24). The presence of the collecting wellbore (24) causes a drop in pressure between the drainage boundary of the formation (26) and the interface between the formation (26) and the collecting wellbore (24). The pressure differential between the collecting wellbore (24) and the average pressure of the hydrocarbons in the formation (26) draws hydrocarbons from the formation (26) into the collecting wellbore (24) and in turn, into the production tubing string (42) through the foramen (44).

The second step comprising the method is displacing the volume of hydrocarbons contained in the production tubing string (42) in the collecting wellbore (24) into the production tubing string (38) in the second downward wellbore (22) in order to develop a column of hydrocarbons within the production tubing string (38). The third step is producing the column of hydrocarbons from the production tubing string (38) in the second downward wellbore (22) to the surface. The collecting, displacing and producing steps are performed in a cyclic manner to create a unidirectional efflux of hydrocarbons from the formation (26) through the wellbores for production at the surface.

In the preferred embodiment of the invention in its method form, the producing step is performed during the displacing step. The producing step and the displacing step are performed concurrently as performance of the displacing step causes the volume of hydrocarbons in the production tubing string (42) in the collecting wellbore (24) to be displaced to the production tubing string (38) in the second downward wellbore (22) and, in turn, the displaced volume of hydrocarbons displaces the column of hydrocarbons developed previously in the production tubing string (38) to the surface. Both the displacing step and the producing step are performed by applying a displacing pressure in the first downward wellbore (20). Therefore, the displacing pressure applied must be sufficient to displace the volume of hydrocarbons from the production tubing string (42) in the collecting wellbore (24) into the production tubing string (38) in the second downward wellbore (22) such that the volume of hydrocarbons displaces the column of hydrocarbons from the production tubing string (38) in the second downward wellbore (22) to the surface.

In the preferred embodiment, the displacing pressure is applied by releasing a compressed gas downward in the first downward wellbore (20) toward the collecting wellbore (24). This is performed by use of the gas lift system described above. The accumulator (48) is charged with sufficient compressed gases from the compressor system (not shown) connected at the point of connection (50) to be able to apply a sufficient displacing pressure on release. During charging of the accumulator (48), the check valve (56) located in the accumulator (48) is closed and the check valves (45) in the foramen (44) of the production tubing string (42) in the collecting wellbore (24) are opened to allow hydrocarbons to be drawn from the formation (26) into the production tubing string (42) through the foramen (44) to perform the collecting step. The time required to charge the accumulator (48) is balanced to match the time required to perform the collecting step in order to enhance the efficiency of the production system. Where the hydrocarbons are particularly viscous, the internal pressure of the production tubing string (42) contained in the collecting wellbore (24) may be reduced by use of the pressure bleed-off line (54) to vent the production tubing string (42) in order to enhance the pressure differential and thereby enhance the inflow potential during the collecting step.

During the collecting step, the column of hydrocarbons contained in the production tubing string (38) in the second downward wellbore (22) is maintained in the production tubing string (38) to minimize the efflux of hydrocarbons from the production tubing string (38) back to the production tubing string (42) in the collecting wellbore (24). The column of hydrocarbons is maintained in the production tubing string (38) in the second downward wellbore (22) by closing of the check valve (46) located in the production tubing string (38) during the collecting step.

Once the accumulator (48) is sufficiently charged, the check valve (56) in the accumulator (48) is opened, and the compressed gas within the accumulator (48) is released at a controlled rate into the production tubing string (36) in the first downward wellbore (20) toward the collecting wellbore (24) to perform the displacing step. As the compressed gas expands, it applies pressure to the hydrocarbons contained in the production tubing strings (36, 42) in the first downward wellbore (20) and the collecting wellbore (24). The check valves (45) in the foramen (44) of the production tubing string (42) in the collecting wellbore (24) are closed during the displacing step to minimize the efflux of hydrocarbons from the production tubing string (42) back into the collecting wellbore (24) and into the formation (26) which may result from applying the displacing pressure. Where no production tubing string (42) is utilized in the collecting wellbore (24), the displacing pressure is monitored and regulated to maintain the displacing pressure during the displacing step at less than the average pressure of the hydrocarbons in the formation (26) and at less than the fracturing pressure of the formation (26) in order to minimize the efflux of hydrocarbons from the collecting wellbore (24) back into the formation (26).

As the compressed gas continues to expand during the displacing step to apply pressure into the production tubing string (38) in the second downward wellbore (22), the check valve (46) located in the production tubing string (38) opens to allow the volume of hydrocarbons in the production tubing string (42) in the collecting wellbore (24) to be displaced into the production tubing string (38) in the second downward wellbore (22) and the column of hydrocarbons developed in that production tubing string (38) in the second downward wellbore (22) to be displaced to the surface.

Once the compressed gas has expended its energy in displacing the hydrocarbons from the production tubing string (42) in the collecting wellbore (24), the displacing step is completed. The hydrostatic head of the column of hydrocarbons in the production tubing string (38) in the second downward wellbore (22) exceeds the remaining displacing pressure exerted by the released compressed gas. The check valve (46) located in the production tubing string (38) in the second downward wellbore (22) is closed to maintain a further column of hydrocarbons in the production tubing string (38). The check valve (56) in the accumulator (48) is also closed, while the check valves (45) in the foramen (44) of the production tubing string (42) in the collecting wellbore (24) are opened. The pressure bleed-off line (54) is also opened to allow further pressure reduction of any gas remaining in the production tubing string (42) in the collecting wellbore (24). The steps comprising the method are then repeated on a cyclic basis. The length of the collecting step and the displacing pressure applied by the released gases from the accumulator (48) may be varied from cycle to cycle based on the volumetric efficiency of the production system to adjust to changing inflow conditions during the collecting step or to improve the displacement of the volume of hydrocarbons during the displacing step.

Where necessary to facilitate or enhance the production of the column of hydrocarbons to the surface, at least a portion of the column of hydrocarbons may be pumped to the surface. Pumping may occur continuously or during the performance of the displacing and producing steps.

This method for producing hydrocarbons may enhance the pressure differential between the production tubing string (42) in the collecting wellbore (24) and the formation (26) on a cyclic basis. Enhancing the pressure differential serves to enhance the inflow potential of the collecting wellbore (24) while at the same time providing an opportunity for the surrounding formation (26) to replace the hydrocarbons removed from the region adjacent to the collecting wellbore (24) thus facilitating optimal production rates. In addition, this method of production, rather than using conventional pumping means, may promote the development of a uniform pressure drawdown along the length of the collecting wellbore (24) regardless of local variations in the formation properties. This may also balance inflow along the entire collecting wellbore (24) and may result in more uniform depletion of the formation (26). In addition, this may reduce the potential for water coning problems or loss of the wellbore due to formation movements induced by the localized drawdown gradients associated with conventional production systems. Further, the method described above may result in the flushing of sand from the wellbores along the entire length of the well with a relatively high velocity flow. The resulting scouring action may reduce sand buildup or bridging in the production tubing string (42).

In a second embodiment of the invention in its method form, the displacing pressure is applied by moving a piston (58) in the downward wellbore (20). This is performed by use of the plunger lift system described above. All other steps in the method are similar to the preferred embodiment of the method. On the upstroke, or upward movement of the piston (58) toward the proximal end of the first downward wellbore (20), the check valves (45) in the foramen (44) of the production tubing string (42) in the collecting wellbore (24) are opened to allow the hydrocarbons to collect in the production tubing string (42) to perform the collecting step. The check valve (46) in the production tubing string (38) in the second downward wellbore (22) is closed during the collecting step to maintain the column of hydrocarbons in the production tubing string (38).

On the downstroke, or downward movement of the piston (58) toward the distal end of the first downward wellbore (20), the displacing pressure is applied to the hydrocarbons in the production tubing string (36) in the first downward wellbore (20) which transmit this pressure to the hydrocarbons in the production tubing string (42) in the collecting wellbore (24) to perform the displacing step. During the displacing step, the check valves (45) in the foramen (44) of the production tubing string (42) in the collecting wellbore (24) are closed to block return flow to the formation (26). The displacing step displaces the volume of hydrocarbons from the production tubing string (42) in the collecting wellbore (24) into the production tubing string (38) in the second downward wellbore (22) which, in turn, performs the producing step by displacing the column of hydrocarbons from the production tubing string (38) in the second downward wellbore (22) to the surface. The check valve (46) in the production tubing string (38) in the second downward wellbore (22) is opened during the displacing step to allow the hydrocarbons to enter the production tubing string (38).

Where necessary, the displacing step may be enhanced by forming a plug of hydrocarbons within the production tubing string (42) in the collecting wellbore (24) prior to the displacing step. The plug is formed by permitting hydrocarbons to collect during the collecting step in a sump located at the connection between the first downward wellbore (20) and the collecting wellbore (24).

In a third embodiment of the invention in its method form, the producing step and the displacing step are performed separately. The displacing step is performed by applying the displacing pressure as described above. The displacing step results in the volume of hydrocarbons collected in the production tubing string (42) in the collecting wellbore (24) being displaced from the production tubing string (42) to the production tubing string (38) in the second downward wellbore (22). The volume of hydrocarbons may be at least partially displaced to a sump (not shown) located in the second downward wellbore (22). Then, the producing step is separately performed by pumping the column of hydrocarbons from the production tubing string (38) in the second downward wellbore (22) to the surface using conventional pumping techniques. Pumping may take place cyclically with the other steps in the method or continuously throughout the method.

In any of the embodiments described above, the method may further comprise the step of heating the volume of hydrocarbons in the collecting wellbore (24) prior to the displacing step in order to reduce the viscosity of the volume of hydrocarbons. The reduced viscosity enhances the performance of the displacing step. Heating occurs by circulating a heated fluid through a heating tubing string contained inside the collecting wellbore (24).

The method used to produce hydrocarbons is substantially unchanged when performing the method in a well having the first and second downward wellbores (20, 22) forming a single downward wellbore (74), as previously described and as shown in FIG. 5. The volume of hydrocarbons from the formation (26) is collected in the outer production tubing string (82) in the collecting wellbore (124) to perform the collecting step. The displacing pressure is applied to the hydrocarbons in the injection string (76) in the single downward wellbore (74) and into the inner production tubing string (80) in the collecting wellbore (124). The displacing pressure transmits a pressure to the hydrocarbons in the inner production tubing string (80) in the collecting wellbore (124) in order to perform the displacing step. During the displacing step, the check valves (145) in the foramen (144) of the outer production tubing string (82) in the collecting wellbore (124) are closed and the check valve (146) in the production string (78) in the single downward wellbore (74) is opened. As a result of the displacing step, the volume of hydrocarbons collected in the outer production tubing string (82) in the collecting wellbore (124) is displaced into the production string (78) in the single downward wellbore (74) and, in turn, the column of hydrocarbons in the production string (78) is displaced to the surface.

If points of communication, including communication valves, are provided for between the injection string (76) and the production string (78) in the downward wellbore (74), the opening and closing of these communication valves is coordinated with the opening of the valve (56), shown in FIG. 3, at the end of the accumulator (48). During the displacing step, the communication valves are closed, to prevent the passage of gases therethrough, while the accumulator valve (56) is opened in order to release the gases into the injection string (76) and the inner production tubing string (80). At times other than during the displacing step, the communication valves may be opened. When open, further compressed gases may be released into the injection string (76), which will pass from the injection string (76) and into the production string (78), while hydrocarbons will not be allowed to flow from the production string (78) back into the injection string (76). As a result, the compressed gases will force the hydrocarbons contained in the production string (78) out of the proximal end of the downward wellbore (74) for production at the surface.

The invention further includes a method for drilling the well described and utilized herein for producing hydrocarbons. In the preferred embodiment, the method of drilling the well for producing liquids, preferably hydrocarbons, from a subterranean formation, is comprised of the following steps. Referring to FIG. 1, a first downward wellbore (20) is drilled from the surface to a first position (60) beneath the surface to form a first downward section (28). The first downward wellbore (20) is then extended by drilling from the first position (60) to a second position (62) within or adjacent to the formation (26) to form a first angle build section (30). The first angle build section (30) is drilled to have a longitudinal axis which gradually deviates from the longitudinal axis of the first downward section (28) to the second position (62). The first downward section (28) and the first angle build section (30) may then be cased using conventional drilling and completion technology.

A first collecting wellbore (64), as shown in FIG. 1, is drilled from the second position (26) on the first downward wellbore (22) for a distance to an end (66) such that the first collecting wellbore (64) is located at least partially within the formation (26).

A second downward wellbore (22) is drilled from the surface to a third position (68) beneath the surface to form a second downward section (32). The second downward wellbore (22) is extended by drilling from the third position (68) to a fourth position (70) within or adjacent to the formation (26) to form a second angle build section (34). The second angle build section (34) is drilled to have a longitudinal axis that gradually deviates from the longitudinal axis of the second downward section (32) towards the first collecting wellbore (64) to the fourth position (70).

By means of precision directional drilling with downhole steerable drilling assemblies and the use of precision directional surveying techniques, including electromagnetic ranging methods, a second collecting wellbore (72), as shown in FIG. 1, is drilled at least partially within the formation from the fourth position (70) on the second downward wellbore (22) to the end (66) of the first collecting wellbore (64). The second collecting wellbore (72) is drilled to have a longitudinal axis that coincides with the longitudinal axis of the first collecting wellbore (64) in the preferred embodiment, as shown in FIGS. 1 and 2. The axes coincide so that the first collecting wellbore (64) and the second collecting wellbore (72) have a smooth intersection and are joined to form a continuous wellbore throughout the well. In the preferred embodiment, the intersection between the two collecting wellbores (64, 72) is sufficiently smooth to permit a liner or casing of a diameter slightly less than the diameters of the collecting wellbores (64, 72) to be run continuously through the intersection interval. If necessary, one of the collecting wellbores may be reamed to a larger diameter to effect the smooth intersection. In the event the intersection is not achieved initially as required, the second collecting wellbore (72) may be plugged back some distance and subsequently drilled out with a slight course revision that will permit the smooth intersection to be made. Once the intersection occurs, the second downward section (32), the second angle build section (34), the first collecting wellbore (64) and the second collecting wellbore (72) may be cased using conventional drilling and completion techniques. The casing of the first collecting wellbore (64) and the second collecting wellbore (72) are then perforated to form a plurality of foramen.

In a second embodiment, the casing of the first and second collecting wellbores (64, 72) may be replaced by the step of installing a perforated liner in the first and second collecting wellbores (64, 72) after casing the cementing the second downward wellbore (22).

In a third embodiment of the drilling method, the first collecting wellbore (64) and the second collecting wellbore (72) have longitudinal axes which do not coincide. In addition, the longitudinal axes of the two collecting wellbores (64, 72) may not be within the same plane. However, the collecting wellbores (64, 72) do intersect to join to form a continuous wellbore throughout the well. This embodiment is not preferred due to difficulties which may arise in placing a casing or liner through the intersection interval due to the bend at the intersection of the collecting wellbores (64, 72). However, the configurations of the collecting wellbores (64, 72), the formation (26) geometry, or the surface location of the proximal ends of the downward wellbores (20, 22) may make this embodiment desirable or necessary.

A fourth embodiment of the drilling method includes the use of existing wellbores in forming a portion of the completed well. For instance, a first method of drilling the well using existing wellbores is comprised of locating an existing first downward wellbore (20) drilled from the surface to a location within or adjacent to the formation (26). An existing second downward wellbore (22) drilled from the surface to a location within or adjacent to the formation (26) is also located. A collecting wellbore (24) is then drilled at least partially within the formation from a location on the existing first downward wellbore (20) to the existing second downward wellbore (22). The collecting wellbore (24) intersects the existing second downward wellbore (22) such that the wellbores are joined to form a continuous wellbore throughout the well.

A second method for drilling the well using existing wellbores is comprised of locating an existing first downward wellbore (20) drilled from the surface to a location within or adjacent to the formation (26). A second downward wellbore (22) is drilled from the surface to a first position beneath the surface to form the downward section (32). The second downward wellbore (22) is then extended by drilling from the first position to a second position within or adjacent to the formation (26) to form the angle build section (34). The angle build section (34) is drilled to have a longitudinal axis gradually deviating from the longitudinal axis of the downward section (32) toward the existing first downward wellbore (20) to the second position. A collecting wellbore (24) is then drilled at least partially within the formation (26) from the second position on the second downward wellbore (22) to the existing first downward wellbore (20). The collecting wellbore (24) is drilled to intersect the existing first downward wellbore (20) such that the existing first downward wellbore (20) and the collecting wellbore (24) are joined to form a continuous wellbore throughout the well.

A third method for drilling the well using existing wellbores is comprised of locating an existing collecting wellbore (24), having an end communicating with the surface, and drilled at least partially within the formation (26). A downward wellbore (22) is then drilled from the surface to the existing collecting wellbore (24) such that the downward wellbore (22) intersects the existing collecting wellbore (24). Thus, the downward wellbore (22) and the existing collecting wellbore (24) are joined to form a continuous wellbore throughout the well.

A fourth method of drilling the well using existing wellbores is comprised of locating an existing first collecting wellbore (64) drilled at least partially within the formation (26) and having an end communicating with the surface. An existing downward wellbore (22) drilled from the surface to a location within or adjacent to the formation (26) is also located. A second collecting wellbore (72) is then drilled at least partially within the formation (26) from a position on the existing downward wellbore (22) to the existing first collecting wellbore (64). The second collecting wellbore (72) is drilled to have a longitudinal axis that intersects the longitudinal axis of the existing first collecting wellbore (64) such that the existing first collecting wellbore (64) and second collecting wellbore (72) are joined to form a continuous wellbore throughout the well.

In a fifth method of drilling the well using existing wellbores, the method is comprised of locating an existing first downward wellbore (20) drilled from the surface to a location within or adjacent to the formation (26). A first collecting wellbore is then drilled from a position on the existing first downward wellbore (20) for a distance such that the first collecting wellbore (64) is located at least partially within the formation (26). An existing second downward wellbore (22), drilled from the surface to a location within or adjacent to the formation (26), is then located. A second collecting wellbore (72) is drilled from a position on the existing second downward wellbore (22) to the first collecting wellbore (64). The second collecting wellbore (72) is located at least partially within the formation (26) and has a longitudinal axis that intersects the longitudinal axis of the first collecting wellbore (64) in order that the first collecting wellbore (64) and the second collecting wellbore (72) are joined to form a continuous wellbore throughout the well.

A sixth method for drilling the well using existing wellbores is comprised of locating an existing first collecting wellbore (64), drilled at least partially within the formation (26) and having an end communicating with the surface. A downward wellbore (22) is drilled from the surface to a first position beneath the surface to form a downward section (32). The downward wellbore (22) is then extended by drilling from the first position to a second position within or adjacent to the formation (26) to form an angle build section (34). The angle build section (34) has a longitudinal axis gradually deviating from the longitudinal axis of the downward section (32) toward the existing first collecting wellbore (64) to the second position. A second collecting wellbore (72) is drilled at least partially within the formation (26) from the second position on the downward wellbore (22) to the existing first collecting wellbore (64). The second collecting wellbore (72) has a longitudinal axis that intersects the longitudinal axis of the existing first collecting wellbore (64) in order that the existing first collecting wellbore (64) and the second collecting wellbore (72) are joined to form a continuous wellbore throughout the well.

In a fifth embodiment of the drilling method, the method may comprise the further step of forming a sump between the first downward wellbore (20) and the first collecting wellbore (64). The sump is formed to have a depth beneath the surface greater than the depth of the first collecting wellbore (64).

In a sixth embodiment of the drilling method, the method may comprise the further step of drilling a plurality of branch collecting wellbores from the main collecting wellbore (24) to further increase contact between the collecting wellbore (24) and the formation (26). The branch collecting wellbores may be cased, lined or open hole.

Finally, in some situations, there may be advantages to drilling multiple wells in a star pattern. The star pattern is completed by drilling multiple first downward wellbores (20) in close proximity to each other. Alternatively, a plurality of production tubing strings (36) may be located in a large, single first downward wellbore (20) to which an equal number of collecting wellbores (24) are connected. A second downward wellbore (22) is connected to each collecting wellbore (24). The second downward wellbores are spaced circumferentially around the single, first downward wellbore (20).

The embodiments of the invention in which an exclusive property or privilege is claimed are defined as follows:

1. A method for producing liquids from a subterranean formation using a well of the type having a downward wellbore for containing a column of liquids and including a proximal end communicating with the surface and a distal end extending beneath the surface, a collecting wellbore for collecting liquids from the formation located at least partially within the formation and communicating with the formation and the downward wellbore, a first downward production tubing string located inside the downward wellbore, and a first collecting production tubing string located inside the collecting wellbore communicating with the first downward production tubing string and the collecting wellbore, the method comprising the steps of:

positioning a second collecting production tubing string inside the collecting wellbore for containing the liquids collected from the formation, the second collecting production tubing string communicating with the first collecting production tubing string and the downward wellbore and having a plurality of foramen for communicating between the inside of the second collecting production tubing string and the collecting wellbore;

collecting the liquids from the formation in the collecting wellbore while the collecting wellbore has an internal pressure less than the average pressure of the liquids in the formation such that a pressure differential exists between the collecting wellbore and the formation in order to draw the liquids from the formation into the collecting wellbore and from the collecting wellbore through the foramen into the second collecting production tubing string;

sealing the foramen in the second collecting production tubing string to minimize the efflux of the liquids from the second collecting production tubing string and displacing a volume of the liquids from the collecting wellbore into the downward wellbore by applying a sufficient displacing pressure in the first downward production tubing string and the first collecting production tubing string to displace the volume of the liquids from the second collecting production tubing string in order that the volume of the liquids displaces the column of liquids within the downward wellbore toward the surface.

2. The method as claimed in claim 1 wherein a second downward production tubing string is located inside the downward wellbore for containing the column of liquids, the second downward production tubing string extending from the proximal end to the distal end of the downward wellbore and communicating with the second collecting production tubing string such that the displacing step displaces the volume of the liquids from the second collecting production tubing string into the second downward production tubing string in order that the volume of the liquids displaces the column of liquids in the second downward production tubing string toward the surface.

3. The method as claimed in claims 1 or 2 further comprising the steps of pumping to the surface from the downward wellbore at least a part of the column of liquids remaining in the downward wellbore after displacement of the column of liquids toward the surface.

4. The method as claimed in claims 1 or 2 wherein the steps are repeated in a cyclic manner to create a unidirectional efflux of the liquids from the formation through the wellbores for production at the surface.

5. The method as claimed in claims 1 or 2 wherein the displacing pressure is applied by releasing a compressed gas in the first downward production tubing string.

6. The method as claimed in claim 5 wherein the compressed gas is steam.

7. The method as claimed in claims 1 or 2 wherein the sealing step is comprised of closing a valve associated with the foramen.

8. The method as claimed in claims 1 or 2 further comprising the step of reducing the internal pressure of the collecting wellbore during the collecting step to enhance the pressure differential between the collecting wellbore and the formation in order to draw the liquids from the formation for collection in the second collecting production tubing string.

9. The method as claimed in claim 8 wherein the pressure reducing step is comprised of venting the second collecting production tubing string.

10. The method as claimed in claims 1 or 2 further comprising the step of reducing the viscosity of the liquids in the collecting wellbore prior to commencement of the displacing step in order to enhance the performance of the displacing step.

11. The method as claimed in claim 10 wherein the viscosity reducing step is comprised of heating the liquids in the collecting wellbore.

12. The method as claimed in claim 1 further comprising the step of maintaining the column of liquids within the downward wellbore upon completion of the displacing step so that the efflux of the liquids from the downward wellbore back to the second collecting production tubing string is minimized.

13. The method as claimed in claim 12 wherein a valve is located in the downward wellbore and the maintaining step is comprised of opening the valve during the displacing step and closing the valve during the collecting step.

14. The method as claimed in claims 1 or 2 wherein the liquids contained in the formation are comprised of hydrocarbons.

15. The method as claimed in claim 2 further comprising the step of maintaining the column of liquids within the second downward production tubing string upon completion of the displacing step so that the efflux of the liquids from the second downward production tubing string to the second collecting production tubing string is minimized.

16. The method as claimed in claim 2 wherein a valve is located in the second downward production tubing string and the maintaining step is comprised of opening the valve during the displacing step and closing the valve during the collecting step.

17. An apparatus for producing liquids from a subterranean formation comprising:

(a) a downward wellbore for containing a column of liquids and having a proximal end communicating with the surface and a distal end extending beneath the surface;

(b) a collecting wellbore for collecting the liquids from the formation, located at least partially within the formation and communicating with the formation and the downward wellbore;

(c) a first downward production tubing string located inside the downward wellbore and extending from the proximal end to the distal end of the downward wellbore;

(d) a first collecting production tubing string located inside the collecting wellbore and communicating with the first downward production tubing string and the collecting wellbore;

(e) means for displacing a volume of the liquids from the collecting wellbore into the downward wellbore by applying a sufficient displacing pressure in the first downward production tubing string and the first collecting production tubing string to displace the volume of the liquids from the collecting wellbore in order that the volume of the liquids displaces the column of liquids within the downward wellbore toward the surface;

(f) a second collecting production tubing string located inside the collecting wellbore for containing the liquids collected from the formation, the second collecting production tubing string communicating with the first collecting production tubing string and the downward wellbore and having a plurality of foramen for communicating between the inside of the second collecting production tubing string and the collecting wellbore such that the displacing means apply the displacing pressure in the first downward production tubing string and the first collecting production tubing string to displace the volume of the liquids from the second collecting production tubing string; and (g) efflux minimizing means for sealing the foramen in the second collecting production tubing string during operation of the displacing means to minimize the efflux of the liquids from the second collecting production tubing string.

18. The apparatus as claimed in claim 17 further comprising a second downward production tubing string located inside the downward wellbore for containing the column of liquids, the second downward production tubing string extending from the proximal end to the distal end of the downward wellbore and communicating with the second collecting production tubing string such that displacement of the volume of the liquids from the second collecting production tubing string displaces the column of liquids within the second downward production tubing string toward the surface.

19. The apparatus as claimed in claim 17 wherein the first collecting production tubing string is located inside the second collecting production tubing string within the collecting wellbore.

20. The apparatus as claimed in claim 18 wherein the first collecting production tubing string is located inside the second collecting production tubing string within the collecting wellbore.

21. The apparatus as claimed in claim 20 wherein the first downward production tubing string and the second downward production tubing string are substantially parallel within the downward wellbore.

22. The apparatus as claimed in claim 17 wherein the displacing means are comprised of a chamber within the first downward production tubing string for containing a compressed gas, and means for releasing the compressed gas downward in the first downward production tubing string.

23. The apparatus as claimed in claim 22 wherein the compressed gas is steam.

24. The apparatus as claimed in claim 17 wherein the efflux minimizing means are comprised of a plurality of valves associated with the foramen which permit the flow of the liquids into the second collecting production tubing string but not out of the second collecting production tubing string.

25. The apparatus as claimed in claim 17 further comprising means for reducing the viscosity of the liquids in the collecting wellbore in order to enhance the displacement of the volume of the liquids by the displacing means.

26. The apparatus as claimed in claim 25 wherein the viscosity reducing means are comprised of means, located within the collecting wellbore, for heating the liquids.

27. The apparatus as claimed in claim 17 further comprising means for reducing the internal pressure of the collecting wellbore to enhance the pressure differential between the collecting wellbore and the formation.

28. The apparatus as claimed in claim 27 wherein the pressure reducing means are comprised of means for venting the second collecting production tubing string.

29. The apparatus as claimed in claim 17 further comprising means for maintaining the column of liquids within the downward wellbore so that the efflux of the liquids from the downward wellbore back to the second collecting production tubing string is minimized.

30. The apparatus as claimed in claim 29 wherein the maintaining means are comprised of a valve located in the downward wellbore which permits the flow of the liquids towards but not away from the proximal end of the downward wellbore.

31. The apparatus as claimed in claim 17 further comprising a sump located in the downward wellbore for containing at least a portion of the column of liquids.

32. The apparatus as claimed in claim 18 further comprising means for maintaining the column of liquids within the second downward production tubing string so that the efflux of the liquids from the second downward production tubing string back to the second collecting production tubing string is minimized.

33. The apparatus as claimed in claim 32 wherein the maintaining means are comprised of a valve located in the second downward production tubing string which permits the flow of the liquids towards but not away from the proximal end of the downward wellbore.

* * * * *